US005099929A

United States Patent [19]

Keith et al.

[11] Patent Number: 5,099,929

[45] Date of Patent: Mar. 31, 1992

[54] UNBALANCED PDC DRILL BIT WITH RIGHT HAND WALK TENDENCIES, AND METHOD OF DRILLING RIGHT HAND BORE HOLES

[75] Inventors: Carl W. Keith; William W. King, both of Spring; Robert I. Clayton, Houston, all of Tex.

[73] Assignee: Dresser Industries, Inc., Dallas, Tex.

[21] Appl. No.: 520,035

[22] Filed: May 4, 1990

[51] Int. Cl.[5] ..... E21B 7/04; E21C 13/06

[52] U.S. Cl. ..... 175/61; 175/398

[58] Field of Search ..... 175/61, 324, 398, 399, 175/415, 408

[56] References Cited

U.S. PATENT DOCUMENTS

| | | | |
|---|---|---|---|
| 3,583,504 | 6/1971 | Aalund | 175/398 |
| 4,440,244 | 4/1984 | Wiredal | 175/398 X |
| 4,508,182 | 4/1985 | Anders | 175/61 |
| 4,638,873 | 1/1987 | Welborn | 175/73 |

*Primary Examiner*—William P. Neuder
*Attorney, Agent, or Firm*—Johnson & Gibbs

[57] ABSTRACT

A rotary drill bit for cutting an earth formation is provided. The drill bit includes a bit body rotatable about its longitudinal axis. A cutting face is provided on the bit body, with a concave central region and a raised outer periphery terminating at bit shoulder. The bit shoulder is concentric with and substantially parallel to the longitudinal axis of the rotary drill bit. A plurality of bit stabilizing pads are circumferentially disposed about the bit's shoulder. A plurality of stationary cutter elements are fixedly mounted to the cutting face in a selected pattern to provide a region of high cutter density on one side of the cutting face, and a region of low cutter density on the other side of the cutting face. The drill bit cuts earth formations as the bit body is rotated about its central axis. The stationary cutter elements operate to cut into the lower side wall of the wellbore as the bit body is rotated, causing the rotary drill bit to walk to the right.

37 Claims, 7 Drawing Sheets

167
159

157
29
159
175
5
153
41
7
4
173
177
2
3
155
161
1
33
6
179
163
165
31

163
169
171

191
183
181
29
33
4
2
7
187
189
185
193
1
3
6
11
31
5
8

193
197
195

201
217
199
29
6
4
2
9
31
11
8
5
3
1
7
10
203
221
205
219

225
223
219

UNBALANCED PDC DRILL BIT WITH RIGHT HAND WALK TENDENCIES, AND METHOD OF DRILLING RIGHT HAND BORE HOLES

BACKGROUND OF THE INVENTION

1. Field of the Invention

The present invention relates generally to polycrystalline diamond compact (PDC) drill bits, and specifically to directional drilling with PDC drill bits.

2. Description of the Prior Art:

In exploring earth formations for oil and gas reserves, it is sometimes useful to drill a hole which is deviated from a vertical position to a substantially horizontal position. However, it is sometimes desirable to drill backward toward a vertical position from a horizontal wellbore.

In certain earth formations, it is desirable to use a polycrystalline diamond compact (PDC) drill bit. Unfortunately, most PDC drill bits do not walk to the right, so it is difficult to correct or change the deviation of a wellbore.

The directional tendencies of oil well drilling bits can be critical to the efficient penetration of oil and gas payzones. The increase in high angle and horizontal well path designs has made bit lateral deviation characteristics, known as bit walk or bit turn, of greater concern.

Rolling cone drill bits have always demonstrated a tendency to turn, or walk, to the right. This is due to the fact that they experience very minimal left hand reactive torque and to the fact that they can experience a drop, bite and fling progression which will be described in more detail below.

PDC bits have nearly always demonstrated a tendency to turn to the left. This is due to their fixed cutting structure creating a hard left hand reactive torque while drilling In prior art, a few PDC bit models have been observed to run in a neutral turn mode and one model has been noted to have a right turn tendency. Heretofore bit designers and directional drillers have not understood the mechanics of PDC bit turn but have only classified and predicted turn tendencies based on field experience.

SUMMARY OF THE INVENTION

It is one objective of the present invention to provide a PDC drill bit which exhibits a tendency to turn to the right;

It is another objective of the present invention to provide a PD drill bit which walks to the right, and is of particular utility in a deviated substantially horizontal wellbore;

It is yet another objective of the present invention to provide an imbalanced PDC drill bit which cooperates with gravity to walk to the right;

The above as well as additional objects, features, and advantages of the invention will become apparent in the following detailed description. A rotary drill bit for cutting an earth formation is provided. The drill bit includes a bit body rotatable about its longitudinal axis. A cutting face is provided on the bit body, with a concave central region and a raised outer periphery terminating at a bit shoulder. The bit shoulder is concentric with and substantially parallel to the longitudinal axis of the rotary drill bit. A plurality of bit stabilizing pads are circumferentially disposed about the bit's shoulder. A plurality of stationary cutter elements are fixedly mounted to the cutting face in a selected pattern to provide a region of high cutter density on one side of the cutting face, and a region of low cutter density on the other side of the cutting face. The drill bit cuts earth formations as the bit body is rotated about its central axis. The stationary cutter elements operate to cut into the lower sidewall of the wellbore as the bit body is rotated, causing the rotary drill bit to walk to the right.

BRIEF DESCRIPTION OF THE DRAWINGS

The novel features believed characteristic of the invention are set forth in the appended claims. The invention itself, however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
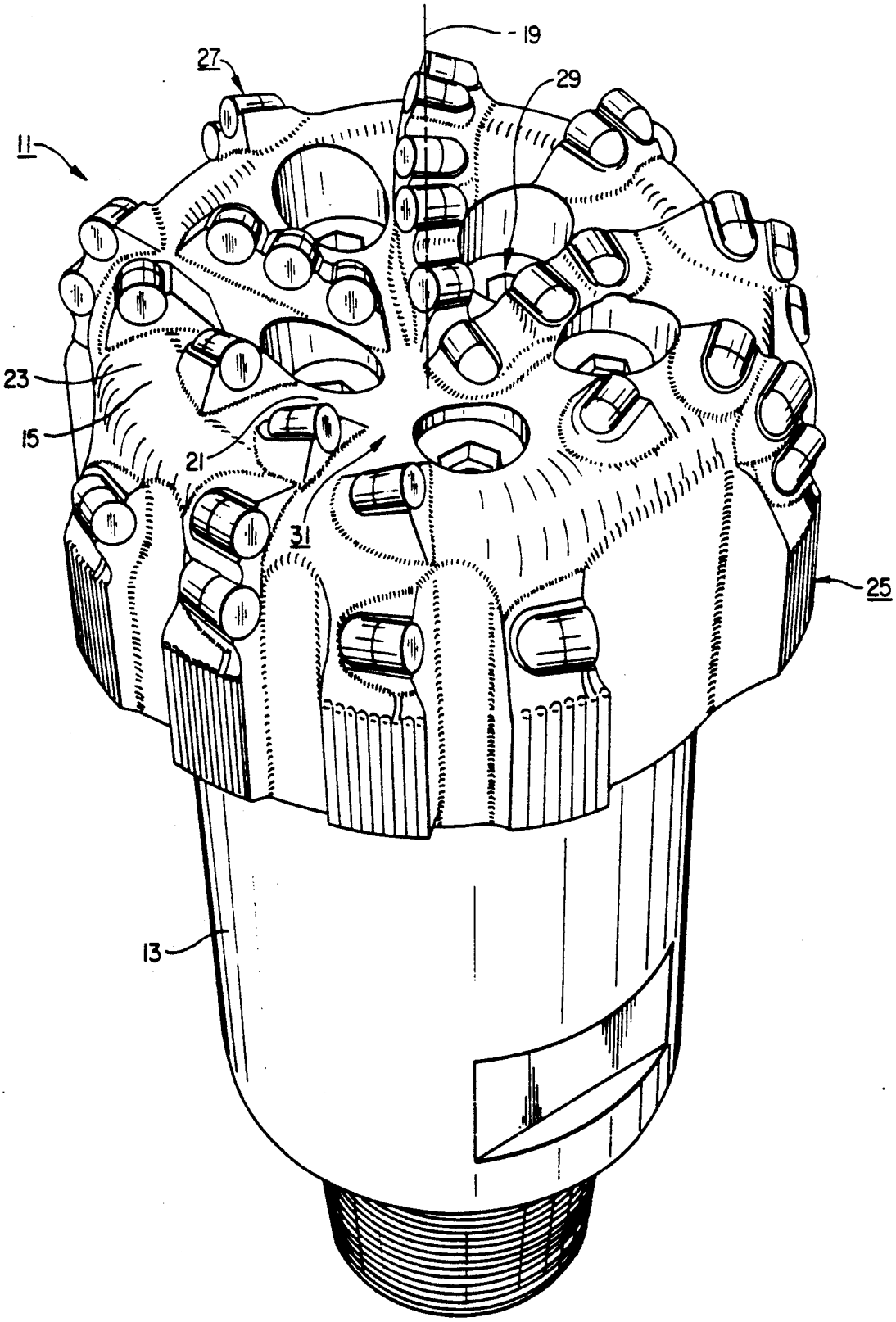
FIG. 1 is perspective view of one embodiment of the preferred right-turn PDC drill bit of the present invention.

FIG. 1 is a perspective view of one embodiment of the preferred right turn PDC drill bit of the present invention. Drill bit 11 includes bit body 13, which is rotatable about its longitudinal axis 19. Cutting face 15 is provided on bit body 13, and includes concave central region 21 and raised outer periphery 23 which terminates at bit shoulder 17, which is concentric with and substantially parallel to longitudinal axis 19.

A plurality of stabilizing pads 25 are circumferentially disposed about bit shoulder 17, and serve to stabilize drill bit 11 within the wellbore. A plurality of polycrystalline diamond compact (PDC) cutters 27 are fixedly mounted to cutting face 15 in a selected pattern to provide a region of high cutter density on one side of cutting face 15, and a region of low cutter density 31 on the other side of cutting face 15.

Figure 2:
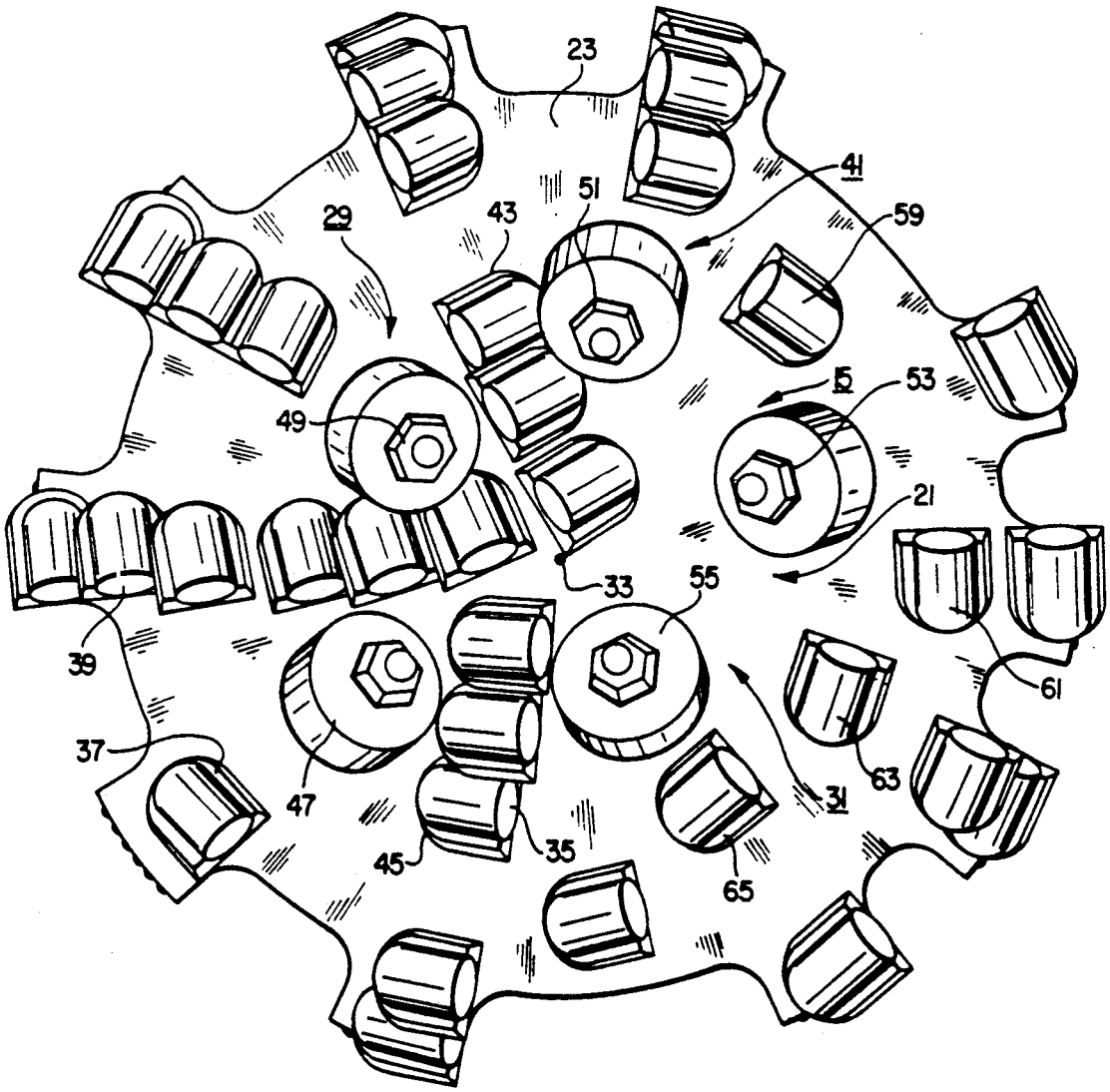
FIG. 2 is a top view of the preferred right-turn PDC drill bit of FIG. 1.

FIG. 2 is a top view of the preferred right turn PDC drill bit of FIG. 1. As shown, cutting face 15 includes a plurality of PDC cutters 27 which are arranged in a pattern to provide a region of high cutter density 29 on one side of cutting face 15, and a region of low cutter density 31 on the opposite side of cutting face 15. PDC cutters 21, like cutter 35, are substantially bullet-shaped, and have a flat and circular cutting area. The PDC cutters 27 are braised in position on cutting face 15 into PDC pockets, like pocket 37.

PDC cutters 27 are positioned on cutting face 15 radially outward from center point 33. In this preferred embodiment, PDC cutters 27 form three large cutting ridges in the region of high cutter density 29, namely first cutting ridge 39, second cutting ridge 43, and third cutting ridge 45.

As shown in FIG. 2, first, second, and third cutting ridges 39, 43, 45 are positioned on the left hand side of cutting face 15, and serve to establish region of high cutter density 29. If cutting face 15 is considered as a clock face, with third cutter ridge 45 at six o'clock, first cutting ridge 39 is positioned at eight o'clock, and second cutting ridge 43 is positioned at ten o'clock.

A plurality of fluid nozzles 41 are disposed on cutting face 15. In the preferred embodiment, five fluid nozzles 41 are provided to flush and cool drill bit 11. Nozzle 47 is positioned between third cutting ridge 45 and first cutting ridge 39. Nozzle 49 is positioned between first cutting ridge 39 and second cutting ridge 43. Nozzle 51 is positioned on the other side of second cutting ridge 43 across from nozzle 49. Nozzle 55 is positioned adjacent third cutting ridge 45 opposite from nozzle 47, and proximate to center point 33. Nozzle 53 is positioned between nozzle 51, and nozzle 55, radially outward from center point 33.

A plurality of isolated cutters 57 are provided on region of low cutter density 31, and include isolated cutter 59, which is positioned between nozzle 51 and nozzle 53, isolated cutter 61 which is positioned adjacent nozzle 53, isolated cutter 63 which is positioned adjacent isolated cutter 61, and isolated cutter 65 which is positioned adjacent nozzle 55. A plurality of other cutters are provided on cutting face 15, particularly along raised outer periphery 23 and stabilizing pads 25.

In the preferred embodiment of FIGS. 1 and 2, the metal structure of drill bit 11 which underlies region of high cutter density 29 may be formed of a material which is denser (and thus heavier) than the metal underlying region of low cutter density 31. This imbalance in weight of bit body 13 will cooperate with the imbalanced arrangement of PDC cutters 27 on cutting face 15 to enhance the right-turn tendencies of the drill bit of the present invention.

Figure 3A:
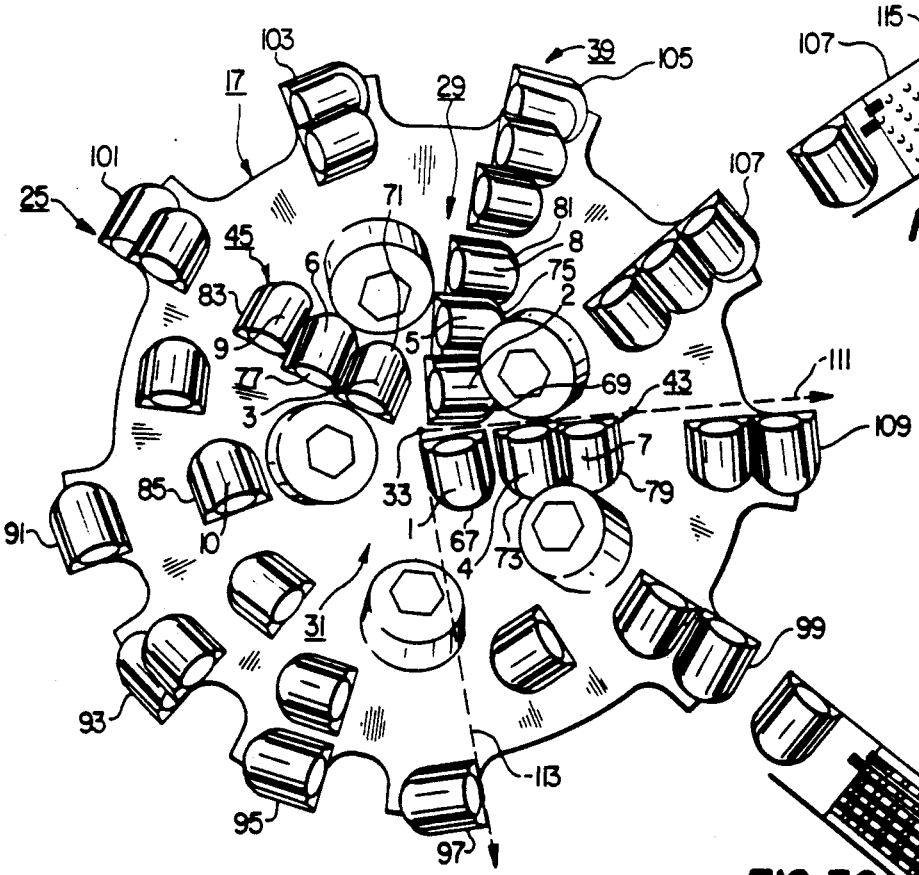
FIG. 3*a* is another top view of the preferred right-turn PDC drill bit of FIGS. 1 and 2, in alignment with two of the stabilizing pads which are shown in FIG. 3*b* and FIG. 3*c* in side views rotated into the same plane as that of FIG. 3*a;*
Figure 3B:
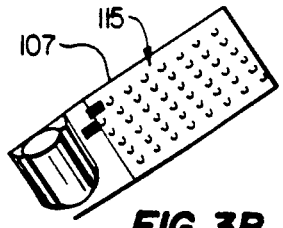
Figure 3C:
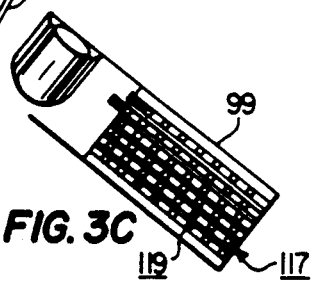

FIG. 3 is another top view of the preferred right-turn PDC drill bit of FIGS. 1 and 2, in alignment with two of the stabilizing pads which are shown in FIGS. 3*b* and 3*c* in side views rotated into the same plane as that of FIG. 3*a*.

The pattern of distribution of PDC cutters 27 may be analyzed by placing the cutters in order of radial proximity to center point 33. As shown in the figure, the PDC cutter 27 closest to center point 33 is PDC cutter 67, which is marked with the number "1." In FIG. 3*a*, the next nine closest PDC cutters 27 are marked with the numerals 2 through 10. The first PDC cutter, PDC cutter 67, is disposed on second cutting ridge 43. The second PDC cutter radially outward from center point 33 is PDC cutter 69, which is disposed on first cutting ridge 39. The third closest PDC cutter 27 to center point 33 is PDC cutter 71, which is disposed on third cutting ridge 45. The fourth closest PDC cutter 27 to center point 33 is PDC cutter 73, which is disposed on second cutting ridge 43. The fifth closest PDC cutter is PDC cutter 75, which is disposed on first cutting ridge. The sixth closest PDC cutter 27 is PDC cutter 77, which is disposed on third cutting ridge 45. The seventh closest PDC cutter is PDC cutter 79, which is disposed on second cutting ridge 43. The eighth closest PDC cutter 27 is PDC cutter 81, which is disposed on first cutting ridge 39. The ninth closest PDC cutter is PDC cutter 83, which is disposed on third cutting ridge 45.

Figures 8A, 8B, 8C:
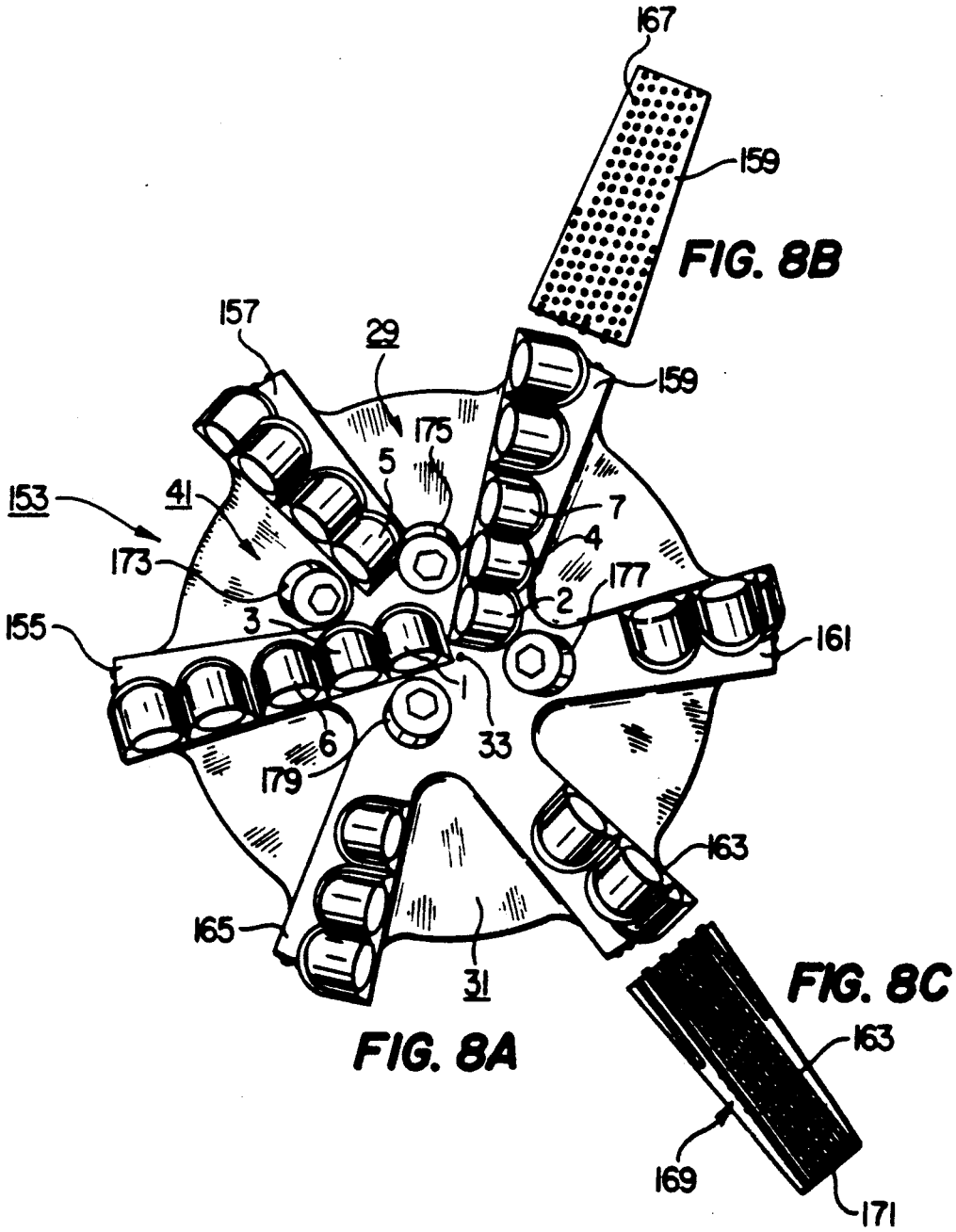
FIG. 8*a* is a top view of an alternate embodiment of the right turn PDC drill bit of the present invention, in alignment with two of the drill bit pads which are shown in FIGS. 8*b* and 8*c* in side views rotated into the same plane as that of FIG. 9*a;*
Figures 9A, 9B, 10A, 10B:
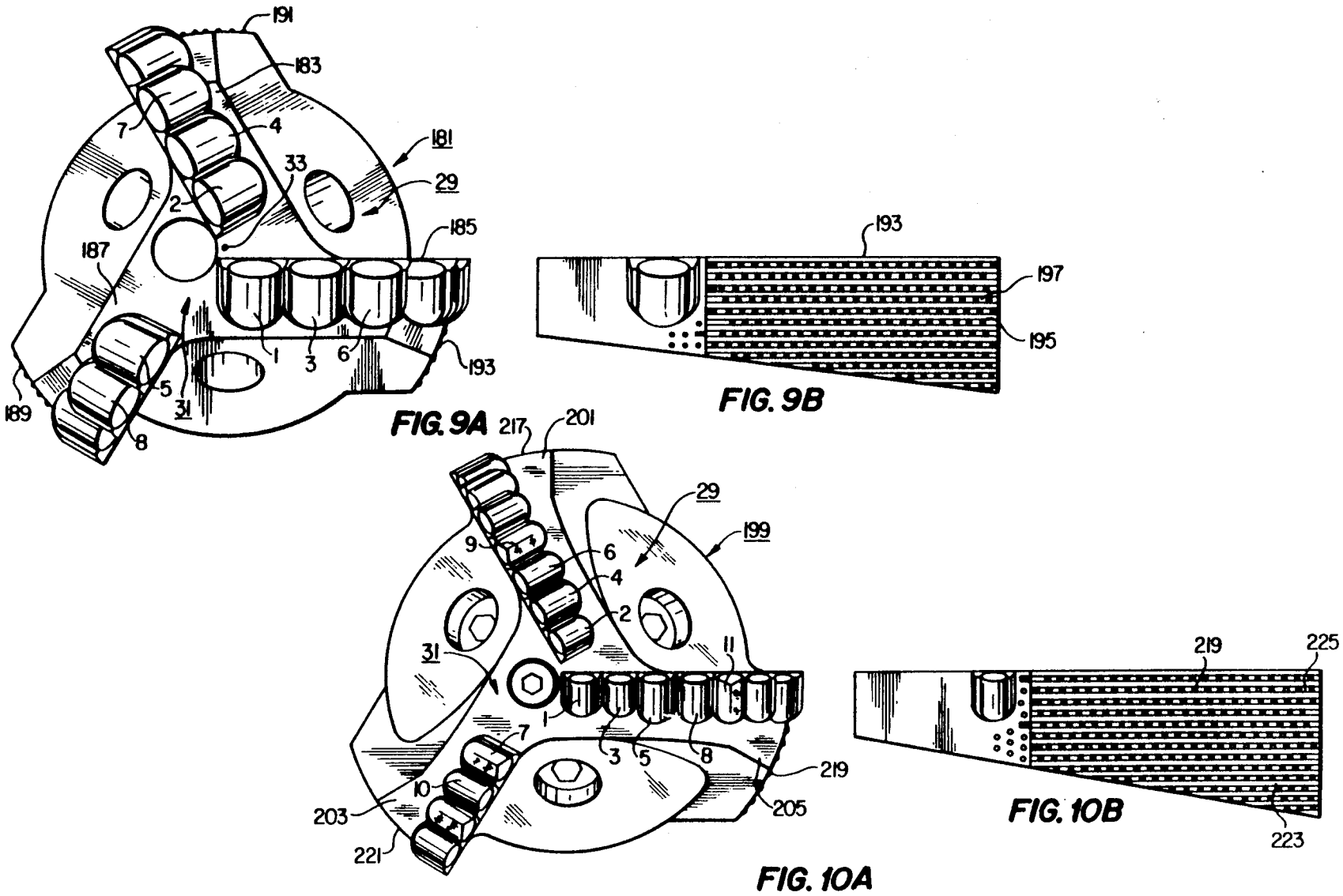
FIG. 9 is a top view of another alternate embodiment of the right-turn PDC drill bit of the present invention.
FIG. 10 is a top view of yet another alternate embodiment of the right-turn PDC drill bit of the present invention.

In this preferred embodiment, the first nine closest PDC cutters 27 are disposed in the region of high cutter density 29. As shown, the region of high cutter density 29 is a substantially triangular region relative to center point 33, which includes at least the first six PDC cutters 27 positioned on cutting face 15 radially outward from center point 33. In this preferred embodiment, PDC cutters 27 have a diameter of less than 0.71 inch. In drill bits with larger diameter PDC cutters, one may not be able to position as may PDC cutters 27 in the region of high cutter density 29. FIGS. 8, 9, 10 address alternate embodiments of the present invention, some of which include PDC cutters 27 which have a diameter larger than 0.71 inch.

Region of low cutter density 31 is a generally semicircular area opposite from region of high cutter density 29. This "void" area has a radial boundary established by the first cutter position radially outward from the center point which is placed opposite the region of high cutter density 29. In the preferred embodiment, PDC cutter 85 (marked "10") establishes the radial boundary for region of low cutter density 31. The imbalanced of distribution of PDC cutters 27 on cutting face 15 results in a drill bit il which has a tendency to walk to the right in the wellbore.

As shown in FIG. 3, drill bit 11 includes a plurality of stabilizing pads 25 which are circumferentially disposed about bit shoulder 17. In this preferred embodiment, there are ten stabilizing pads 25. Four of the stabilizing pads (stabilizing pads 91, 93, 95, and 97) are positioned on the side of cutting face 15 which contains the region of low cutter density 31. Four of stabilizing pads 25 (stabilizing pads 103, 105, 107, and 109) are positioned on the side of cutting face 15 adjacent region of high cutter density 29. Two of stabilizing pads are positioned at transitional points along a center line which divides region of high cutter density 29 from region of low cutter density 31, namely stabilizing pads 99, and 101.

In the preferred embodiment, selected ones of stabilizing pads 25 have a radial width relative to center point 33 which differs from the remaining stabilizing pads 25. Specifically, stabilizing pads 105, 107, and 109 have a first radial width 111 which is less than a second radial width 113 of the remaining stabilizing pads 25. Of course, stabilizing pads 105, 107, and 109 (the pads with first radial width 111) are generally aligned with region of high cutter density 29, and serve to enhance the right-hand walk tendencies of drill bit 11.

The differences between first radial width 111 and second radial width 113 is quite small in the preferred embodiment. FIGS. 3*b* and 3*c* are views of stabilizing pads 107 and 99, and exhibit the structure which defines the difference in radial width between first radial width 111 and second radial width 113. FIG. 3*b* depicts the "undersized" stabilizing pad 107. Diamonds 115 are directly embedded in stabilizing pad 107. FIG. 3*c* is a view of stabilizing pad 99, which has second radial width 113, which is greater than first radial width 111. As shown, stabilizing pad 99 includes a plurality of parallel raised ribs 117, onto which diamonds 119 are affixed. In the preferred embodiment, the difference in length between first radial width 111 and second radial width 113 is twenty-five one-thousandths of an inch (0.025).

Figure 4:
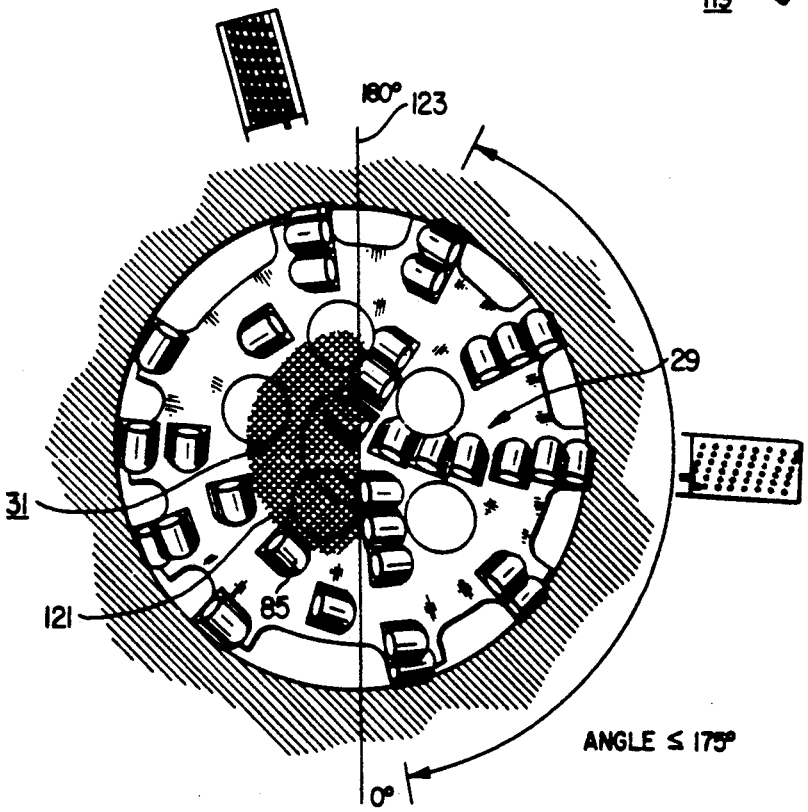
FIG. 4 is a top view of the preferred right-turn PDC drill bit of FIGS. 1–3, with a reference line superimposed thereon.

FIG. 4 is a view, as if looking through drill bit to the bottom of the wellbore, of the preferred right-turn PDC drill bit of FIGS. 1–3. As shown, region of high cutter density 29 falls to one side of center line 123. Region of low cutter density 31 falls on the opposite side of center line 123, and has radial boundary 121 established by PDC cutter 85.

Figure 5A:
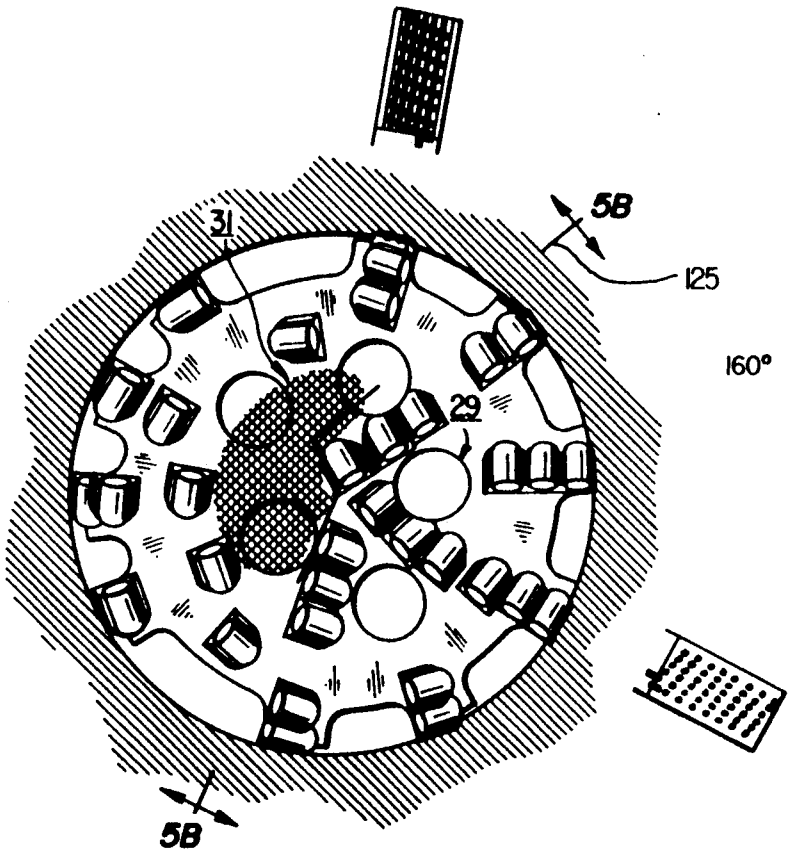
FIG. 5*a* is a view of the preferred right-turn PDC drill bit of FIGS. 1 through 4 as if looking through the drill bit at the bottom of the wellbore.
Figure 5B:
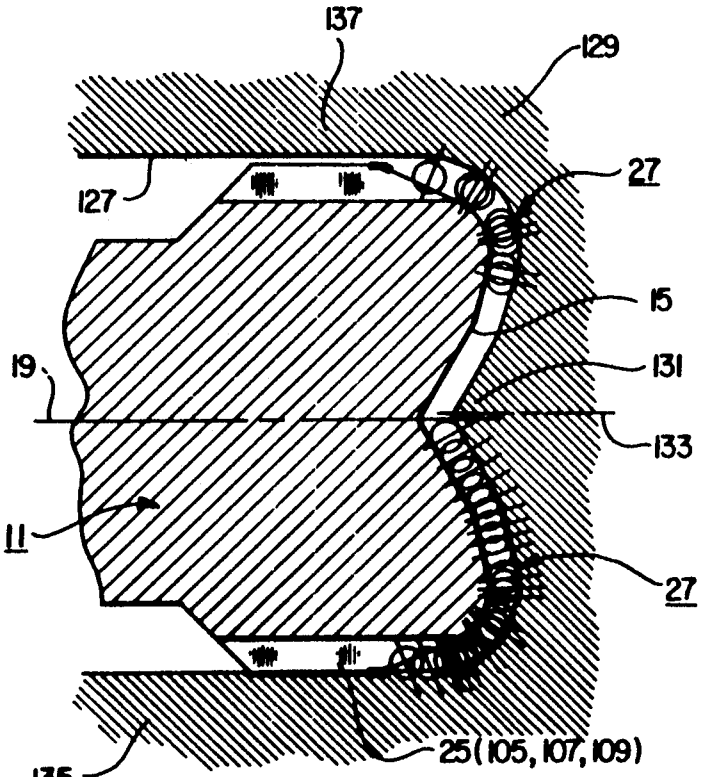
FIG 5*b* is a cross-section view of the preferred right-turn PDC drill bit of FIGS. 1–4, in formation in a horizontal wellbore.

The operation of the preferred drill bit 11 of FIGS. 1 through will now be described with reference to FIGS. 5, 6, and 7. FIG. 5*a* is a view of the preferred right-turn PDC drill bit of FIGS. 1 through 4, as if looking through the drill bit at the bottom of the wellbore. Dividing line 125 separates region of high cutter density 29 from region of low cutter density 31. As shown, region of high cutter density 29 is a generally triangular region. FIG. 5*b* is a cross-section view of FIG. 5*a*, as seen along dividing line 125 with the PDC cutters 27 in region of high cutter density 29 rotated into a single plane, and PDC cutters 27 of region of low cutter density 31 rotated into another single plane. PDC cutters 27 are graphically depicted as circles disposed on cutting face 15.

In FIG. 5*b*, drill bit 11 is shown in a substantially horizontal wellbore 127 surrounded by earth formation 129. As shown, the distribution of PDC cutters 27 serves to create a "void" area in the cutting profile of drill bit 11. The undersized stabilizing pads 25 (specifically, stabilizing pads 105, 107, and 109) serve to allow drill bit 11 to drop downward slightly off of formation cone 131, in response to gravity. In the half cycle of rotation shown in FIG. 5*b*, longitudinal axis 19 of drill bit 11 is offset slightly from cone axis 133.

In the preferred embodiment, the portion of drill bit 11 which underlies region of high cutter density 29 has a greater weight than the portion of bit 11 which underlies the opposite region of low cutter density 31. The weight differential, the stabilizing pad differential, and the cutting distribution differential of drill bit 11 cooperate to cut formation 129 to a greater extent along lower wellbore sidewall 135 than upper wellbore sidewall 137.

Figure 6B:
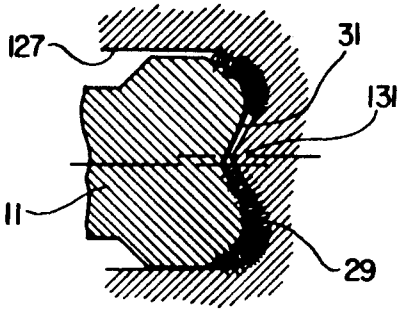
FIGS. 6*a* and 6*b* are cross-section views of the preferred right-turn PDC drill bit of the present invention at different rotation positions in a horizontal wellbore.
Figure 6A:
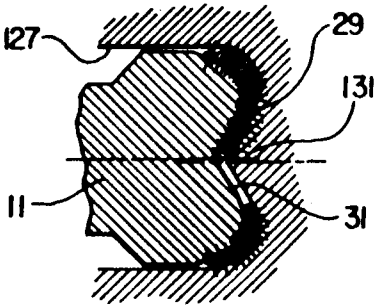

FIGS. 6*a* and 6*b* are cross-section views of the preferred right-turn PDC drill bit of FIGS. 1 through 5 of the present invention at different rotation positions in a horizontal wellbore. In FIG. 6*a*, region of low cutter density 31 is in a down position, with the cutters which comprise region of high cutter density 29 actively cutting the formation cone 131 (the formation cone is a conical-shaped protrusion of formation 129 which Conforms in shape to concave central region 21 of drill bit 11). In FIG. 6*b* drill bit 11 is shown with region of high cutter density 29 in a down position. In this configuration. region of high cutter density 29 operates to cut the lower wellbore sidewall.

These half cycles may be referred to as formation cutting and cone cutting half cycles of rotation. In the formation cutting half cycle of rotation, at least one undersized stabilizing pad 25 is oriented downward into contact with lower wellbore sidewall 135, and drill bit 11 drops off formation cone 131 by force of gravity to cut the earth formation 129 with the region of high concentration of cutters elements 29. In the cone cutting half cycle of rotation, at least one undersized stabilizing pad 25 is oriented upward into contact with upper sidewall and the region of high concentration of cutter elements 29 cuts into formation cone 131. The repeated and combined cutting of the lower sidewall and formation cone in this manner causes the drill bit to turn to the right.

Figure 7:
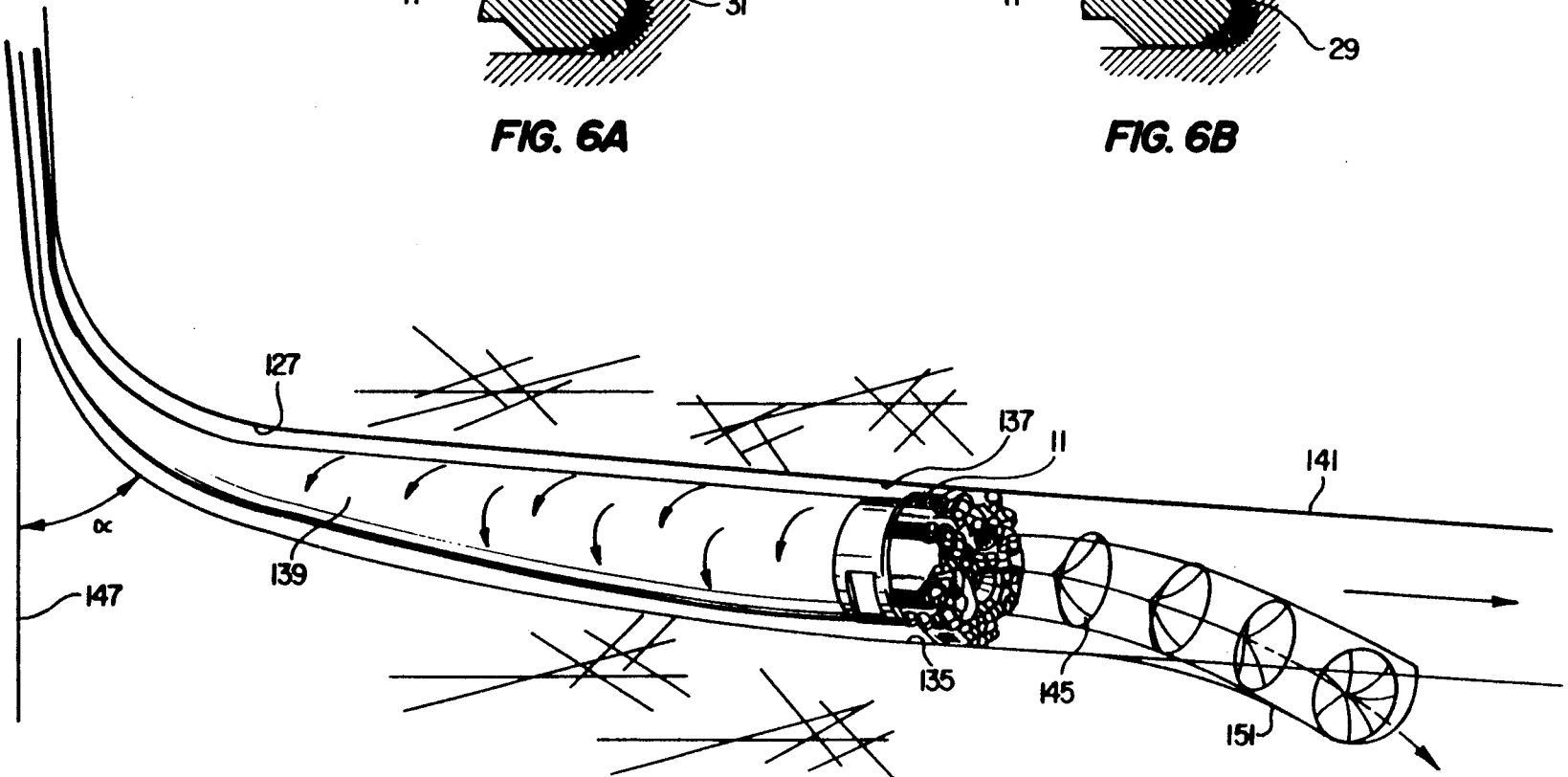
FIG. 7 is a view of the preferred right-turn PDC drill bit in a deviated and substantially horizontal wellbore, with two alternate wellbore trajectories: one trajectory without use of the right-turn PDC drill bit, and one with use of the right-turn PDC drill bit of the present invention.

FIG. 7 is a view of the preferred right-turn PDC drill bit in a deviated and substantially horizontal wellbore 127, which is deviated at an angle alpha from a vertical reference line 147. With an ordinary PDC drill bit, a typical bit trajectory would be like that of bit trajectory 141. However, with the improved PDC drill bit 11 of the present invention, lower wellbore sidewall 135 is cut to a greater extent than upper wellbore sidewall 137, resulting in a "right-turn" trajectory, as shown by cone progression trajectory 145. As shown, the right turn trajectory 151 is both radially inward toward vertical reference 147, and to the right. Consequently, the improved drill bit 11 of the present invention is extremely useful in correcting wellbores which have become overly horizontal, and can also be used to develop a wellbore which progresses slightly radially inward toward a vertical axis.

The present invention may also be characterized as a method of directional drilling in a non-vertical wellbore which extends downward from a surface into an earth formation, which is deviated radially outward from a vertical axis, and which includes a wellbore bottom having a formation cone and an upper sidewall region and a lower sidewall region. First, a drill string is provided and coupled to a drill bit, the drill bit having a cutting face with a region with a high concentration of cutter elements relative to other regions on the cutting face. Then, a plurality of stabilizing pads are provided and radially disposed about the drill bit, and include at least one undersized stabilizing pad which is aligned with the region of high concentration of cutter elements. The drill string and connected drill bit is rotated in a clockwise direction to cut the earth's formation.

During a formation cutting half cycle of rotation, the at least one undersized stabilizing pad is oriented downward into contact with the lower sidewall, and the drill bit drops off the formation cone by force of gravity to cut the earth formation with the region of high concentration of cutter elements. During a cone cutting half cycle of rotation, the at least one undersized stabilizing pad is oriented upward into contact with the upper sidewall and the region of high concentration of cutter elements cuts into the formation cone. The repeated and combined cutting of the lower sidewall and formation cone in this manner causes the drill bit to turn to the right.

With reference now to FIG. 8, alternate drill bit 153 includes six equally spaced apart raised ridges, each containing a plurality of PDC cutters 27. Ridges 155, 157, 159 define a region of high cutter density 29. Ridges 161, 163, 165 define region of low cutter density 31. PDC cutters 27 of alternate drill bit 153 are numbered in order of proximity from center point 33. The first, third, and sixth PDC cutter 27 are aligned on ridge 155. The second, fourth and seventh PDC cutters 27 are aligned on ridge 159. The fifth PDC cutter 27 is positioned on ridge 157. The eighth PDC cutter is positioned on ridge 165. Thus, the first through seventh PDC cutters 27 are positioned in the region of high cutter density 29. The eighth PDC cutter 27 is positioned on ridge 165 in the region of low cutter density 31, defining the outer radial boundary of region of low cutter density 31. In this embodiment, PDC cutters 27 are one inch diameter cutters.

Like the drill bit 11 of FIGS. 1 through 7, alternate drill bit 153 includes a plurality of stabilizing pads 25. In this embodiment, six stabilizing pads 25 are aligned with ridges 155, 157, 159, 161, 163, and 165. (For purposes of simplicity, the ridges and stabilizing pads are referred to by the same numerals.) Stabilizing pad 159 includes a plurality of diamonds 167 which are embedded in the metal. Stabilizing pads 155, 157 are similarly constructed. Stabilizing pads 155, 157, 159 all have a first radial diameter from center point 33 which differs from the radial diameter of stabilizing pads 161, 163, 165. As shown in FIG. 8*c*, stabilizing pad 163 includes a plurality of parallel ridges which are encrusted with diamonds 71.

The embodiment of FIG. 8 further includes a plurality of fluid nozzles 41. Fluid nozzle 173 is positioned between ridges 155 and 157. Fluid nozzle 175 is positioned between ridges 157 and 159. Fluid nozzle 177 is positioned on ridge 161. Fluid nozzle 179 is positioned in the central region of alternate drill bit 153 adjacent ridge 155, and opposite fluid nozzle 173.

Like the drill bit 11 of FIGS. 1 through 7, alternate drill bit 153 may include regions of bit body 13 which have different density materials. Together, the density of PDC cutters, undersized stabilizing pads 25, and weight differential operate to make the alternate drill bit 153 turn or walk to the right.

FIG. 9 is a top view of another alternate embodiment of the right-turn PDC drill bit of the present invention. Alternate drill bit 181 includes ridges 183, 185, 187 which converge at the center of alternate bit 181. As in the other Figures, PDC cutters 27 are numbered in order of distance from center point 33 of alternate drill bit 181. The first, third, and sixth PDC cutters 27 are positioned along ridge 185. The second, fourth, and seventh PDC cutters 27 are positioned on ridge 183. The fifth and eighth cutters are positioned on ridge 187. Together, the PDC cutters 27 on ridges 183, 185 form the region of high cutter density 29. The fifth PDC cutter 27 establishes the outer radial boundary for region of low cutter density 31.

The alternate drill bit of FIG. 9 further includes three stabilizing pads 25, namely stabilizing pad 189 which is aligned with ridge 187, stabilizing pad 191 which is aligned with ridge 183, and stabilizing pad 193 which is aligned with ridge 185. In this embodiment, stabilizing pad 191 is undersized relative to the other stabilizing pads. The normal-sized stabilizing pad 25 include a plurality of raised parallel ribs 197 encrusted with diamonds 195. The under-sized stabilizing pad 191 does not carry parallel raised ribs 195, but rather has a plurality of diamonds embedded in the metal structure.

FIG. 10 is a view of yet another alternate embodiment of the drill bit 11 of the present invention. The drill bit revealed in FIG. 10 is similar to that of FIG. 9, but its adapted for smaller diameter PDC cutters 27. Three spaced apart ridges 201. 203, 205 carry PDC cutters 27. Ridge 205 carries the first, third, fifth, eighth and eleventh PDC cutters 27. Ridge 201 carries the second, fourth, sixth, and ninth PDC cutters. Ridge 203 carries the seventh and tenth PDC cutters. Together, ridges 201, 205 serve to define the region of high cutter density 29. In this design, the first six PDC cutters 27 are positioned within region of high cutter density 29. The seventh PDC cutter 27 serves to establish the outward radial boundary of region of low cutter density 31.

Three stabilizing pads 25 are disposed about bit shoulder 17 in alignment with ridges 201, 203, 205. Stabilizing pad 217 is aligned with ridge 201. Stabilizing pad 219 is aligned with ridge 205. Stabilizing pad 221 is aligned with ridge 203. As with other designs, one stabilizing pad 25 (specifically stabilizing pad 217) is undersized relative to the others. Stabilizing pads 219, 221 include a plurality of raised parallel ribs 223 which are encrusted with diamond 225.

The embodiment of FIGS. 1 through 7 includes a region of high cutter density which spans an arc of approximately 160 degrees relative to the center point 33 of cutting face 15. The alternate embodiments of FIGS. 8, 9, 10 disclose drill bits which have a region of high cutter density 29, which expands an arc of 120 degrees relative to center point 33 of cutting face 15. Depending upon the PDC cutter 27 size, either the first four or the at least six PDC cutters fall within the region of high cutter density 29.

Although the invention has been described with reference to a specific embodiment, this description is not meant to be construed in a limiting sense. Various modifications of the disclosed embodiment as well as alternative embodiments of the invention will become apparent to persons skilled in the art upon reference to the description of the invention. It is therefore contemplated that the appended claims will cover any such modifications or embodiments that fall within the true scope of the invention.

What is claimed is:

1. A rotary drill bit for cutting in earth formations, for use in a deviated wellbore which extends downward from a surface and includes an upper sidewall region and a lower sidewall region, comprising:

a bit body rotatable about its longitudinal axis;

a cutting face on said bit body, with a concave central region and a raised outer periphery terminating at a bit shoulder, said bit shoulder being concentric with and substantially parallel to said longitudinal axis;

a plurality of bit stabilizing pads circumferentially disposed about said bit shoulder;

a plurality of stationary cutter elements fixedly mounted to said cutting face in a selected pattern to provide a region of high cutter density on one side of said cutting face and a region of low cutter density on the other side of said cutting face, for cutting said earth formation as said bit body is rotated about said central axis; and wherein said stationary cutter elements operate to cut into said lower sidewall of said wellbore as said bit body is rotated, causing said rotary drill bit to walk to the right.

2. A rotary drill bit for cutting in earth formations according to claim 1, further comprising:

a plurality of fluid discharge nozzles terminating at said cutter face for emitting a pressurized drilling fluid to flush and cool said drill bit.

3. A rotary drill bit for cutting in earth formations according to claim 1, wherein said cutters comprise polycrystalline diamond compact cutters.

4. A rotary drill bit for cutting in earth formations according to claim 1, wherein said region of high cutter density occupies a region on said cutting face between 72 degrees and 175 degrees relative to a center point on said cutting face.

5. A rotary drill bit for cutting in earth formations according to claim 1, wherein said region of high cutter density comprises a generally triangular region of less than 175 degrees relative to a center point on said cutting face, which includes at least the first six cutters positioned on said cutting face radially outward from a center point on said cutting face.

6. A rotary drill bit for cutting in earth formations according to claim 1, wherein said region of high cutter density comprises a generally triangular region of less than 175 degrees relative to a center point on said cutting face, which includes at least the first four cutters positioned on said cutting face radially outward from said center point on said cutting.

7. A rotary drill bit for cutting in earth formations according to claim 1, wherein said cutters comprise polycrystalline diamond compact cutters having a diameter less than 0.71 inches each, wherein said region of high cutter density comprises a region defined by the placement of the first six cutters positioned on said cutting face radially outward from a center point on said cutting face.

8. A rotary drill bit for cutting in earth formations according to claim 1, wherein said cutters comprise polycrystalline diamond compact cutters having a diameter equal to or greater than 0.71 inches each, wherein said region of high cutter density comprises a region defined by the placement of the first four cutters positioned radially outward from a center point on said cutting face.

9. A rotary drill bit for cutting in earth formations according to claim 1, wherein said cutters comprise polycrystalline diamond compact cutters having a diameter less than 0.71 inches, wherein said region of high cutter density comprises a region defined by the placement of at least the first six cutters positioned on said cutting face radially outward from a center point on said cutting face, and wherein said region of low cutter density includes a region with no cutters opposite from said region of high cutter density between said center point and a radial boundary established by the first cutter positioned radially outward from said center point which is placed opposite said region of high cutter density.

10. A rotary drill bit for cutting in earth formations according to claim 1, wherein said cutters comprise polycrystalline diamond compact cutters having a diameter equal to or greater than 0.71 inches, wherein said region of high cutter density comprises a region defined by the placement of at least the first four cutters positioned on said cutting face radially outward from a center point on said cutting face, and wherein said region of low cutter density includes a region with no cutters opposite from said region of high cutter density between said center point and a radial boundary established by the first cutter positioned radially outward from said center point which is placed opposite said region of high cutter density.

11. A rotary drill bit for cutting in earth formations for use in a deviated wellbore which extends downward from a surface and includes an upper sidewall region and a lower sidewall region, comprising:

a bit body rotatable about its longitudinal axis;

a cutting face on said bit body, with a concave central region and a raised outer periphery terminating at a bit shoulder, said bit shoulder being concentric with and substantially parallel to said longitudinal axis;

a plurality of bit stabilizing pads circumferentially disposed about said bit shoulder, selected ones of said stabilizing pads have a first radial width relative to said longitudinal axis which is less than a second radial width of selected others of said stabilizing pads;

a plurality of stationary cutter elements fixedly mounted to said cutting face in a selected pattern to provide a region of high cutter density on one side of said cutting face and a region of low cutter density on the other side of said cutting face, for cutting said earth formation as said bit body is rotated about said central axis; and wherein said stationary cutter elements operate to cut into said lower sidewall of said wellbore as said bit body is rotated, causing said rotary drill bit to walk to the right.

12. A rotary drill bit for cutting in earth formations for use in a deviated wellbore which extends downward from a surface and includes an upper sidewall region and a lower sidewall region, comprising:

a bit body rotatable about its longitudinal axis;

a cutting face on said bit body, with a concave central region and a raised outer periphery terminating at a bit shoulder, said bit shoulder being concentric with and substantially parallel to said longitudinal axis;

a plurality of bit stabilizing pads circumferentially disposed about said bit shoulder, selected ones of said stabilizing pads have a first radial width relative to said longitudinal axis which is less than a second radial width of selected others of said stabilizing pads, and wherein said stabilizing pads having said first radial width are disposed along said bit shoulder adjacent said region of high cutter density, placing said region of high cutter density in close proximity to said lower sidewall region during at least a portion of the drill bit rotation and allowing said cutter elements to cut into said lower sidewall of said wellbore.

a plurality of stationary cutter elements fixedly mounted to said cutting face in a selected pattern to provide a region of high cutter density on one side of said cutting face and a region of low cutter density on the other side of said cutting face, for cutting said earth formation as said bit body is rotated about said central axis; and wherein said stationary cutter elements operate to cut into said lower sidewall of said wellbore as said bit body is rotated, causing said rotary drill bit to walk to the right.

13. A rotary drill bit for cutting in earth formations for use in a deviated wellbore which extends downward from a surface and includes an upper sidewall region and a lower sidewall region, comprising:

a bit body rotatable about its longitudinal axis;

a cutting face on said bit body, with a concave central region and a raised outer periphery terminating at a bit shoulder, said bit shoulder being concentric with and substantially parallel to said longitudinal axis;

a plurality of bit stabilizing pads circumferentially disposed about said bit shoulder;

a plurality of stationary cutter elements fixedly mounted to said cutting face in a selected pattern to provide a region of high cutter density on one side of said cutting face and a region of low cutter density on the other side of said cutting face, for cutting said earth formation as said bit body is rotated about said central axis;

a portion of said bit body underlying the side of said cutting face which carries said region of high cutter density has a greater weight than a portion of the bit underlying the opposite side of said cutting face which carries said region of low cutter density;

wherein said stationary cutter elements operate to cut into said lower sidewall of said wellbore as said bit body is rotated, causing said rotary drill bit to walk to the right.

14. A rotary drill bit for cutting in earth formations, for use in a deviated wellbore which extends downward from a surface and includes an upper sidewall region and a lower sidewall region, comprising:

a bit body rotatable about its longitudinal axis;

a cutting face on said bit body, with a concave central region and a raised outer periphery terminating at a bit shoulder, said bit shoulder being concentric with and substantially parallel to said longitudinal axis;

a plurality of bit stabilizing pads circumferentially disposed about said bit shoulder, selected ones of said stabilizing pads having a first radial width relative to said longitudinal axis less than a second radial width of selected others of said stabilizing pads;

a plurality of stationary cutter elements fixedly mounted to said cutting face in a selected pattern to provide a region of high cutter density on one side of said cutting face and a region of low cutter density on the other side of said cutting face, for cutting said earth formation as said bit body is rotated about said central axis; and wherein said stationary cutter elements operate to cut into said lower sidewall of said wellbore as said bit body is rotated, causing said rotary drill bit to walk to the right.

15. A rotary drill bit for cutting in earth formations according to claim 14, further comprising:

a plurality of fluid discharge nozzles terminating at said cutter face for emitting a pressurized drilling fluid to flush and cool said drill bit.

16. A rotary drill bit for cutting in earth formations according to claim 14, wherein said cutters comprise polycrystalline diamond compact cutters.

17. A rotary drill bit for cutting in earth formations according to claim 14, wherein said stabilizing pads having said first radial width are disposed on said bit shoulder on the side of said cutting face which includes said region of high cutter density, placing said region of high cutter density in close proximity to said earth formation at said lower sidewall during at least a portion of the drill bit rotation.

18. A rotary drill bit for cutting in earth formations according to claim 14, wherein a portion of said bit body underlying the side of said cutting face which carries said region of high cutter density is heavier than a portion of the bit body underlying the opposite side of said cutting face which carries said region of low cutter density.

19. A rotary drill bit for cutting in earth formations according to claim 14, wherein said region of high cutter density occupies a region on said cutting face between 72 degrees and 175 degrees relative to a center point on said cutting face.

20. A rotary drill bit for cutting in earth formations according to claim 14, wherein said region of high cutter density comprises a generally triangular region of less than 175 degrees relative to a center point on said cutting face, which includes at least the first six cutters positioned on said cutting face radially outward from said center point on said cutting face.

21. A rotary drill bit for cutting in earth formations according to claim 14, wherein said region of high cutter density comprises a generally triangular region of less than 175 degrees relative to a center point on said cutting face, which includes at least the first four cutters positioned on said cutting face radially outward from said center point on said cutting.

22. A rotary drill bit for cutting in earth formations according to claim 14, wherein said cutters comprise polycrystalline diamond compact cutters having a diameter less than 0.71 inches each, wherein said region of high cutter density comprises a region defined by the placement of the first six cutters positioned on said cutting face radially outward from a center point on said cutting face.

23. A rotary drill bit for cutting in earth formations according to claim 14, wherein said cutters comprise polycrystalline diamond compact cutters having a diameter greater than 0.71 inches each, wherein said region of high cutter density comprises a region defined by the placement of the first four cutters positioned radially outward from a center point on said cutting face.

24. A rotary bit drill for cutting in earth formations, for use in a deviated wellbore which extends downward from a surface and includes an upper sidewall region and a lower sidewall region, comprising:

a bit body rotatable about its longitudinal axis;

a cutting face on said bit body, with a concave central region and a raised outer periphery terminating at a bit shoulder, said bit shoulder being concentric with and substantially parallel to said longitudinal axis;

a plurality of bit stabilizing pads circumferentially disposed about said bit shoulder wherein selected ones of said stabilizing pads have a first radial width relative to said longitudinal axis less than a second radial width of selected others of said stabilizing pads; and a plurality of stationary cutter elements fixedly mounted to said cutting face in a selected pattern, wherein said stationary cutter elements operate to cut into said lower sidewall of said wellbore as said bit body is rotated, causing said rotary drill bit to walk to the right.

25. A rotary drill bit for cutting in earth formations according to claim 24, further comprising:

a plurality of fluid discharge nozzles terminating at said cutter face for emitting a pressurized drilling fluid to flush and cool said drill bit.

26. A rotary drill bit for cutting in earth formations according to claim 24, wherein said plurality of stationary cutter elements include a region of high cutter density on one side of said cutting face and a region of low cutter density on the other side of the cutting face, and wherein said stabilizing pads having said first radial width are disposed along said bit shoulder adjacent said region of high cutter density, placing said region of high cutter density in close proximity to said earth formation at said lower sidewall region of said wellbore during at least a portion of the drill bit rotation.

27. A rotary drill bit for cutting in earth formations according to claim 24, wherein said cutters comprise polycrystalline diamond compact cutters.

28. A rotary drill bit for cutting in earth formations according to claim 24, wherein a portion of said bit body underlying the side of said cutting face which carries said region of high cutter density has a greater weight than a portion of the bit body underlying the opposite side of said cutting face which carries said region of low cutter density.

29. In a nonvertical wellbore, which extends downward from a surface into earth formations, which is deviated radially outward from a vertical axis, and which includes a wellbore bottom having a formation cone and an upper sidewall region above a lower sidewall region, a method of directional drilling, comprising:

providing a drill string coupled to a drill bit, said drill bit including a cutting face with a region with a high concentration of cutter elements relative to other regions of said cutting face;

providing a plurality of stabilizing pads radially disposed about said drill bit including at least one undersized stabilizing pad, said at least one undersized stabilizing pad aligned with said region with said high concentration of cutter elements;

rotating said drill string and connected drill bit in a clockwise direction to cut said earth formation;

wherein during a formation cutting half cycle of said rotation said at least one undersized stabilizing pad is oriented downward into contact with said lower sidewall and said drill bit drops off said formation cone by force of gravity to cut said earth formation with said region of high concentration of cutter elements;

wherein during a cone cutting half cycle of said rotation said at least one undersized stabilizing pad is oriented upward into contact with said upper sidewall and said region of high concentration of cutter elements cuts said formation cone;

wherein the repeated and combined cutting of said lower sidewall and said formation cone causes said drill bit to turn to the right.

30. A rotary bit drill for cutting in earth formations, for use in a deviated wellbore which extends downward from a surface and includes an upper sidewall region and a lower sidewall region, comprising:

a bit body rotatable about its longitudinal axis;

a cutting face on said bit body, with a concave central region and a raised outer periphery terminating at a bit shoulder, said bit shoulder being concentric with and substantially parallel to said longitudinal axis;

a plurality of bit stabilizing pads circumferentially disposed about said bit shoulder;

a plurality of stationary cutter elements fixedly mounted to said cutting face in a selected pattern to provide a region of high cutter density on one side of said cutting face and a region of low cutter density on the other side of said cutting face, for cutting said earth formation as said bit body is rotated about said central axis; and said stationary cutter elements have a flat cutting area facing substantially in the direction of rotation of said drill bit whereby said cutter elements operate to cut into said lower sidewall of said wellbore as said bit body is rotated causing said rotary drill bit to walk to the right.

31. A rotary drill bit for cutting in earth formations according to claim 30, wherein said region of high cutter density occupies a region on said cutting face between 72 degrees and 175 degrees relative to a center point on said cutting face.

32. A rotary drill bit for cutting in earth formations according to claim 30, wherein said region of high cutter density comprises a generally triangular region of less than 175 degrees relative to a center point on said cutting face, which includes at least the first six cutters positioned on said cutting face radially outward from a center point on said cutting face.

33. A rotary drill bit for cutting in earth formations according to claim 30, wherein said region of high cutter density comprises a generally triangular region of less than 175 degrees relative to a center point on said cutting face, which includes at least the first four cutters positioned on said cutting face radially outward from said center point on said cutting.

34. A rotary drill bit for cutting in earth formations according to claim 30, wherein said cutters comprise polycrystalline diamond compact cutters having a diameter less than 0.71 inches each, wherein said region of high cutter density comprises a region defined by the placement of the first six cutters positioned on said cutting face radially outward from a center point on said cutting face.

35. A rotary drill bit for cutting in earth formations according to claim 30, wherein said cutters comprise polycrystalline diamond compact cutters having a diameter equal to or greater than 0.71 inches each, wherein said region of high cutter density comprises a region defined by the placement of the first four cutters positioned radially outward from a center point on said cutting face.

36. A rotary drill bit for cutting in earth formations according to claim 30, wherein said cutters comprise polycrystalline diamond compact cutters having a diameter less than 0.71 inches, wherein said region of high cutter density comprises a region defined by the placement of at least the first six cutters positioned on said cutting face radially outward from a center point on said cutting face, and wherein said region of lower cutter density includes a region with no cutters opposite from said region of high cutter density between said center point and a radial boundary established by the first cutter positioned radially outward from said center point which is placed opposite said region of high cutter density.

37. A rotary drill bit for cutting in earth formations according to claim 30, wherein said cutters comprise polycrystalline diamond compact cutters having a diameter equal to or greater than 0.71 inches, wherein said region of high cutter density comprises a region defined by the placement of at least the first four cutters positioned on said cutting face radially outward from a center point on said cutting face, and wherein said region of low cutter density includes a region with no cutters opposite form said region of high cutter density between said center point and a radial boundary established by the first cutter positioned radially outward from said center point which is placed opposite said region of high cutter density.

* * * * *